US007699947B2

(12) United States Patent
Seux et al.

(10) Patent No.: US 7,699,947 B2
(45) Date of Patent: Apr. 20, 2010

(54) ULTRAHIGH STRENGTH HOT-ROLLED STEEL AND METHOD OF PRODUCING BANDS

(75) Inventors: Mireille Seux, Ayguieres (FR); Christophe Issartel, Arles (FR); Fabienne Roumegoux, Martigues (FR)

(73) Assignee: USINOR, Puteaux (FR)

( * ) Notice: Subject to any disclaimer, the term of this patent is extended or adjusted under 35 U.S.C. 154(b) by 924 days.

(21) Appl. No.: 10/542,107

(22) PCT Filed: Jan. 14, 2004

(86) PCT No.: PCT/FR2004/000058

§ 371 (c)(1),
(2), (4) Date: Apr. 20, 2006

(87) PCT Pub. No.: WO2004/070064

PCT Pub. Date: Aug. 19, 2004

(65) Prior Publication Data

US 2006/0207692 A1 Sep. 21, 2006

(30) Foreign Application Priority Data

Jan. 15, 2003 (FR) ..... 03 00371

(51) Int. Cl.
*C22C 38/00* (2006.01)
*C21D 1/84* (2006.01)

(52) U.S. Cl. ..... 148/602; 148/654; 148/657; 148/661; 148/333; 148/337; 72/365.2; 420/104

(58) Field of Classification Search ..... 148/602
See application file for complete search history.

(56) References Cited

U.S. PATENT DOCUMENTS 4,388,122 A 6/1983 Sudo et al.
4,407,680 A * 10/1983 Gladman et al. ..... 148/653
4,472,208 A * 9/1984 Kunishige ..... 148/602
4,501,626 A 2/1985 Sudo et al.
6,264,760 B1 * 7/2001 Tamehiro et al. ..... 148/336
6,328,826 B1 12/2001 Iung et al.
6,364,968 B1 4/2002 Yasuhara et al.

FOREIGN PATENT DOCUMENTS

DE 2133744 A 1/1973
JP 11199984 A * 7/1999

OTHER PUBLICATIONS

Patent Abstracts of Japan, vol. 1998, No. 02, Jan. 30, 1998 -& JP 09-263884 A (Kobe Steel Ltd), Oct. 7, 1997, abstract.
Patent Abstracts of Japan, vol. 018, No. 632 (C-1280), Dec. 2, 1994 -& JP 06 240356 A (Sumitomo Metal Ind Ltd), Aug. 30, 1994, abstract.
Patent Abstracts of Japan, vol. 016, No. 172 (C-0933), Apr. 24, 1992 -& JP 04 017641 A (Toa Steel Co Ltd), Jan. 22, 1992, abstract.

* cited by examiner

*Primary Examiner*—Roy King
*Assistant Examiner*—Christopher Kessler
(74) *Attorney, Agent, or Firm*—Sughrue Mion, PLLC

(57) ABSTRACT

The invention relates to ultrahigh strength hot-rolled steel having a chemical composition consisting of, by weight:

0.05%≦C≦0.1%
0.7%≦Mn≦1.1%
0.5%≦Cr≦1.0%
0.05%≦Si≦0.3%
0.05%≦Ti≦0.1%
Al≦0.07%
S≦0.03%
P≦0.05% the remainder comprising iron and impurities resulting from the production thereof. Moreover, the inventive steel has a bainitic-martensitic structure which can contain up to 5% ferrite. The invention also relates to a method of producing bands of said steel.

12 Claims, No Drawings

ULTRAHIGH STRENGTH HOT-ROLLED STEEL AND METHOD OF PRODUCING BANDS

This application is the United States national stage entry of International Application PCT/FR04/00058 filed Jan. 14, 2004, and claims priority to French application 03/00371 filed Jan. 15, 2003.

BACKGROUND OF THE INVENTION

The present invention relates to an ultrahigh-strength hot-rolled steel and to a process for manufacturing strip from this steel, the structure of which is of the bainite-martensite type and may contain up to 5% ferrite.

DESCRIPTION OF THE PRIOR ART

Ultrahigh-strength steels have been developed in recent years, especially so as to meet the specific requirements of the automobile industry, which are in particular to reduce the weight, and therefore the thickness, of parts and to improve safety, by increasing the fatigue strength and impact behavior of the parts. These improvements must also not degrade the formability of the sheets used to manufacture the parts.

This formability assumes that the steel has a high elongation A (greater than 10%) and a yield strength E to tensile strength $R_m$ ratio of low value.

The improvement in the impact behavior of the formed parts may be carried out in various ways and, in particular, using steels possessing, on the one hand, a high elongation A and, on the other hand, an $E/R_m$ ratio of low value, thereby making it possible, after forming and thanks to the consolidation capacity of the steel, to increase its yield strength.

The fatigue behavior of the parts defines their lifetime on the basis of the stresses to which they are subjected, and this may be improved by increasing the tensile strength $R_m$ of the steel. However, increasing the tensile strength reduces the formability of the steel, thus limiting the parts that can be produced, in particular as regards their thickness.

The term "ultrahigh-strength steel" is understood within the context of the present invention to mean a steel whose tensile strength $R_m$ is greater than 800 MPa.

A first family of ultrahigh-strength steels is known, these being steels containing high proportions of carbon (more than 0.1%) and of manganese (more than 1.2%), the structure of the steels being entirely martensitic. They have a tensile strength of greater than 1000 MPa, obtained by a hardening heat treatment, but they have an elongation A of less than 8%, which precludes any forming operation.

A second family of ultrahigh-strength steels consists of what are called dual-phase steels, having a structure consisting of about 10% ferrite and 90% martensite. These steels exhibit very good formability, but with tensile strength levels not exceeding 800 MPa.

SUMMARY OF THE INVENTION

The object of the present invention is to remedy the drawbacks of the steels of the prior art by proposing an ultrahigh-strength hot-rolled steel, capable of being formed and exhibiting improved fatigue behavior and impact behavior.

DESCRIPTION OF THE PREFERRED EMBODIMENTS

For this purpose, the first subject of the invention is an ultrahigh-strength hot-rolled steel, characterized in that its chemical composition comprises, by weight:

0.05%≦C≦0.1%
0.7%≦Mn≦1.1%
0.5%≦Cr≦1.0%
0.05%≦Si≦0.3%
0.05%≦Ti≦0.1%
Al≦0.07%
S≦0.03%
P≦0.05% the balance being iron and impurities resulting from the smelting, said steel having a bainite-martensite structure that may contain up to 5% ferrite.

In a preferred embodiment, the chemical composition furthermore comprises, by weight:

0.08%≦C≦0.09%
0.8%≦Mn≦1.0%
0.6%≦Cr≦0.9%
0.2%≦Si≦0.3%
0.05%≦Ti≦0.09%
Al≦0.07%
S≦0.03%
P≦0.05% the balance being iron and impurities resulting from the smelting.

In another preferred embodiment, the structure of the steel according to the invention consists of 70 to 90% bainite, 10 to 30% martensite and 0 to 5% ferrite, and more particularly preferably of 70 to 85% bainite, 15 to 30% martensite and 0 to 5% ferrite.

The steel according to the invention may also have the following features, taken individually or in combination:

a tensile strength $R_m$ of 950 MPa or higher;
an elongation at break A of 10% or higher;
a yield strength E of 680 MPa or higher; and
an $E/R_m$ ratio of less than 0.8.

The second subject of the invention is a process for manufacturing a strip of ultrahigh-strength hot-rolled steel according to the invention, in which a slab, whose composition comprises:

0.05%≦C≦0.1%
0.7%≦Mn≦1.1%
0.5%≦Cr≦1.0%
0.05%≦Si≦0.3%
0.05%≦Ti≦0.1%
Al≦0.07%
S≦0.03%
P≦0.05%, the balance being iron and impurities resulting from the smelting, is hot-rolled, the rolling temperature being below 950° C., then the strip thus obtained is cooled down to a temperature of 400° C. or below, maintaining a cooling rate of greater than 50° C./s between 800 and 700° C., and then said strip is coiled at a coiling temperature of 250° C. or below.

In a preferred embodiment, the composition of the slab is the following:

0.08%≦C≦0.09%
0.8%≦Mn≦1.0%
0.6%≦Cr≦0.9%
0.2%≦Si≦0.3%
0.05%≦Ti≦0.09%
Al≦0.07%
S≦0.03%
P≦0.05% the balance being iron and impurities resulting from the smelting.

In another preferred embodiment, the hot-rolled steel strip is coated with zinc or a zinc alloy, by dipping it into a bath of molten zinc or zinc alloy following the coiling operation and after having been uncoiled, and then annealed.

The process according to the invention firstly consists in hot-rolling a slab of specific composition, so as to obtain a uniform structure. The rolling temperature is below 950° C., preferably below 900° C.

After the rolling operation, the strip thus obtained is cooled down to a temperature of 400° C. or below, maintaining a cooling rate of greater than 50° C./s between 800 and 700° C. This rapid cooling is carried out in such a way that less than 5% ferrite forms, the presence of ferrite being undesirable as titanium would preferentially precipitate in this phase. The above cooling rate is preferably between 50° C./s and 200° C./s.

Next, the process consists in coiling the strip at a coiling temperature of 250° C. or below. The temperature of this step is limited so as to prevent tempering of the martensite, which would reduce the mechanical strength and would raise the yield strength, hence giving a poor $E/R_m$ ratio.

The composition according to the invention contains carbon with a content of between 0.05% and 0.100%. This element is essential for obtaining good mechanical properties, but it must not be present in an excessively large amount, as it could generate segregation. A carbon content of less than 0.100 makes it possible in particular to achieve good weldability, and an improvement in the forming and endurance limit properties.

The composition also contains manganese with a content of between 0.7% and 1.1%. Manganese improves the yield strength of the steel, while greatly reducing its ductility, and so its content is limited. A content of less than 1.1% also prevents any segregation during continuous casting.

The composition also contains chromium with a content of between 0.50% and 1.0%. A minimum content of 0.50% favors the appearance of bainite in the microstructure. However, its content is limited to 1.0% since a high chromium content would increase the amount of ferrite formed to greater than 5%, because of its ability to induce the alpha-phase.

The composition also contains silicon with a content of between 0.05% and 0.3%. Silicon greatly improves the yield strength of the steel, while slightly reducing its ductility and degrading its coatability, which explains why its content is limited.

The composition also contains titanium with a content of between 0.05 and 0.1%. This element allows the mechanical properties to be substantially improved by a precipitation effect during the rolling and cooling steps. It does not increase the hot hardness because of its moderate content. Its content is limited to 0.1% in order to avoid degrading the impact strength properties, the hot hardness and the bendability.

The composition may also contain phosphorus with a content of less than 0.05%, as beyond this it would pose segregation problems during continuous casting.

The composition also contains aluminum with a content of less than 0.07%, which is introduced when killing the steel during smelting in the steelworks.

EXAMPLES

By way of nonlimiting example, and so as to better illustrate the invention, a grade of steel was smelted. Its composition is given in the table below:

| | C | Mn | Cr | Si | Ti | S | P | Al |
|---|---|---|---|---|---|---|---|---|
| A | 0.078 | 0.95 | 0.79 | 0.233 | 0.094 | 0.001 | 0.038 | 0.048 |

The balance of the composition consists of iron and inevitable impurities resulting from the smelting.

ABBREVIATIONS EMPLOYED $R_m$: tensile strength in MPa;

$R_{p0.2}$: yield strength in MPa;

A: elongation, measured in %.

Three specimens were prepared from grade A, by rolling them at 860° C. and then subjecting them to different thermomechanical pathways. The cooling rates between 800 and 700° C. and the coiling temperature were varied, so as to bring out the structural differences obtained.

Next, the mechanical properties of the steels obtained were measured. The results are given in the table below:

| Trial | $V_{800\text{-}700}$ (° C.) | $T_{coil}$ (° C.) | $R_m$ (MPa) | $R_{p0.2}$ (MPa) | $E/R_m$ | A % |
|---|---|---|---|---|---|---|
| 1* | 57 | 200 | 995 | 690 | 0.7 | 14 |
| 2 | 42 | 200 | 780 | 635 | 0.8 | 14 |
| 3 | 20 | 400 | 800 | 705 | 0.9 | — |

*according to the invention.

The microstructure of trial 1, according to the invention, was of bainite-martensite type, while the microstructure of trials 2 and 3 was of ferrite-bainite type.

The table shows that a cooling rate between 800 and 700° C. of less than 50° C./s causes ferrite to be present in a proportion of greater than 5%. Titanium then precipitates in this ferrite, this no longer making it possible to achieve the desired level of mechanical properties, in particular a high $R_m$.

Moreover, a coiling temperature above 250° C., combined with a cooling rate between 800 and 700° C. of less than 50° C./s, increases the yield strength without increasing the tensile strength. The $E/R_m$ ratio is therefore too high.

Finally, the table shows that a cooling rate between 800 and 700° C. of greater than 50° C./s combined with a coiling temperature below 250° C. gives excellent tensile strength and yield strength values. The essentially bainite-martensitic structure gives the product a good $E/R_m$ ratio and an elongation of greater than 10%.

Furthermore, the steel according to the invention exhibits good coatability by dipping in a bath of molten metal, such as zinc or a zinc alloy, or aluminum or one of its alloys.

The invention claimed is:

1. An ultrahigh-strength hot-rolled steel, wherein its chemical composition comprises, by weight:

$0.05\% \leqq C \leqq 0.1\%$ $0.7\% \leqq Mn \leqq 1.1\%$ $0.5\% \leqq Cr \leqq 1.0\%$ $0.05\% \leqq Si \leqq 0.3\%$ $0.05\% \leqq Ti \leqq 0.1\%$ $Al \leqq 0.07\%$ $S \leqq 0.03\%$ $P \leqq 0.05\%$ the balance being iron and impurities resulting from the smelting, said steel having a bainite-martensite structure that may contain up to 5% ferrite.

2. The steel as claimed in claim 1, wherein its composition furthermore comprises:

0.08%≦C≦0.09%
0.8%≦Mn≦1.0%
0.6%≦Cr≦0.9%
0.2%≦Si≦0.3%
0.05%≦Ti≦0.09%
Al≦0.07
S≦0.03%
P≦0.05% the balance being iron and impurities resulting from the smelting, said steel having a bainite-martensite structure that may contain up to 5% ferrite.

3. The steel as claimed in claim 1, wherein furthermore its structure consists of 70 to 90% bainite, 10 to 30% martensite and 0 to 5% ferrite.

4. The steel as claimed in claim 2, wherein furthermore its structure consists of 70 to 90% bainite, 10 to 30% martensite and 0 to 5% ferrite.

5. The steel as claimed in claim 1, which has a tensile strength $R_m$ of 950 MPa or higher.

6. The steel as claimed in claim 1, which has an elongation at break A of 10% or higher.

7. The steel as claimed in claim 1, which has a yield strength E of 680 MPa or higher.

8. The steel as claimed in claim 1, which has an $E/R_m$ ratio of less than 0.8.

9. A process for manufacturing a strip of ultrahigh-strength hot-rolled steel as claimed in claim 1, wherein a slab, whose composition comprises:

0.05%≦C≦0.1%
0.7%≦Mn≦1.1%
0.5%≦Cr≦1.0%
0.05%≦Si≦0.3%
0.05%≦Ti≦0.1%
Al≦0.07%
S≦0.03%
P≦0.05% the balance being iron and impurities resulting from the smelting, is hot-rolled, the rolling temperature being below 950° C., then the strip thus obtained is cooled down to a temperature of 400° C. or below, maintaining a cooling rate of greater than 50° C./s between 800 and 700° C., and then said strip is coiled at a coiling temperature of 250° C. or below.

10. The manufacturing process as claimed in claim 9, wherein furthermore a slab whose composition comprises:

0.08%≦C≦0.09%
0.8%≦Mn≦1.0%
0.6%≦Cr≦0.9%
0.2%≦Si≦0.3%
0.05%≦Ti≦0.09%
Al≦0.07
S≦0.03%
P≦0.05% the balance being iron and impurities resulting from the smelting, is hot-rolled.

11. The manufacturing process as claimed in claim 9, wherein the hot-rolled steel strip is coated with zinc or a zinc alloy, by dipping it into a bath of molten zinc or zinc alloy following said coiling operation and after having been uncoiled, and then annealed.

12. The manufacturing process as claimed in claim 10, wherein the hot-rolled steel strip is coated with zinc or a zinc alloy, by dipping it into a bath of molten zinc or zinc alloy following said coiling operation and after having been uncoiled, and then annealed.

* * * * *